US005131448A

United States Patent [19]

Miller

[11] Patent Number: 5,131,448

[45] Date of Patent: Jul. 21, 1992

[54] PANEL DEVICE

[75] Inventor: Melvin M. Miller, Nashville, Ind.

[73] Assignee: Channel-Kor Systems Inc., Bloomington, Ind.

[21] Appl. No.: 725,557

[22] Filed: Jul. 3, 1991

[51] Int. Cl.[5] ..... A47G 5/00

[52] U.S. Cl. ..... 160/135; 160/231.1

[58] Field of Search ..... 160/135, 351, 230, 231.1, 160/231.2; 52/239; 40/605

[56] References Cited

U.S. PATENT DOCUMENTS

| | | | |
|---|---|---|---|
| 3,601,916 | 8/1971 | Epstein | 40/605 |
| 3,662,807 | 5/1972 | Miller | 160/135 |
| 3,709,237 | 1/1973 | Smith | 160/231.1 X |
| 4,147,198 | 4/1979 | Ytter | 160/135 |
| 4,194,313 | 3/1980 | Downing | 160/135 X |
| 4,436,135 | 3/1984 | Ytter | 160/135 |
| 4,531,564 | 7/1985 | Hanna | 160/351 |
| 4,711,046 | 12/1987 | Herrgord | 40/605 |
| 4,958,671 | 9/1990 | Bove | 160/135 |
| 5,016,374 | 5/1991 | Engstrom | 160/135 X |
| 5,024,015 | 6/1991 | Quarles | 40/605 |

*Primary Examiner*—David M. Purol

[57] ABSTRACT

The invention is concerned with a foldable panel device which is useful in the display arts. The foldable panel device is particularly useful as a portable display for use at trade shows. The foldable panel device incorporates a pair of upper and lower panel sections which are pivotally connected to each other on a horizontal plane. The upper and lower panel sections have lateral panels connected thereto and which are capable of depending outwardly therefrom for display purposes. It is preferred that two lateral panels depend outwardly from each vertical side of said upper and lower panel sections.

17 Claims, 2 Drawing Sheets 38
48
46
42
24
47

34
18
20
12
56
38
24
50
40
32
22

38
2
24
2
4
10
4
32
30
40
16
26
14
20
10
24
16
12
14
32
28

50
52

54
40
32

19
13
17
12
68
66
50
64
60
62
70

21
23
15
64
62
19
19
13
12
60
14

PANEL DEVICE

BACKGROUND

This invention is concerned with portable, flexible, panel devices which can be used to display information at trade shows and conventions. Panel devices as may be used at trade shows or conventions are of two principle types, these being the large bulky type and the portable type. This invention is concerned with the portable type of display device. The portable display devices have become very popular in recent years for utilization at regional trade shows and conventions. These portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled and disassembled only with great difficulty by extra workmen at great expense. In particular, this invention is concerned with portable displays which can be set up on a table top.

DESCRIPTION OF THE PREFERRED EMBODIMENT

Figures 1, 2, 3, 4, 5, 6, 7:
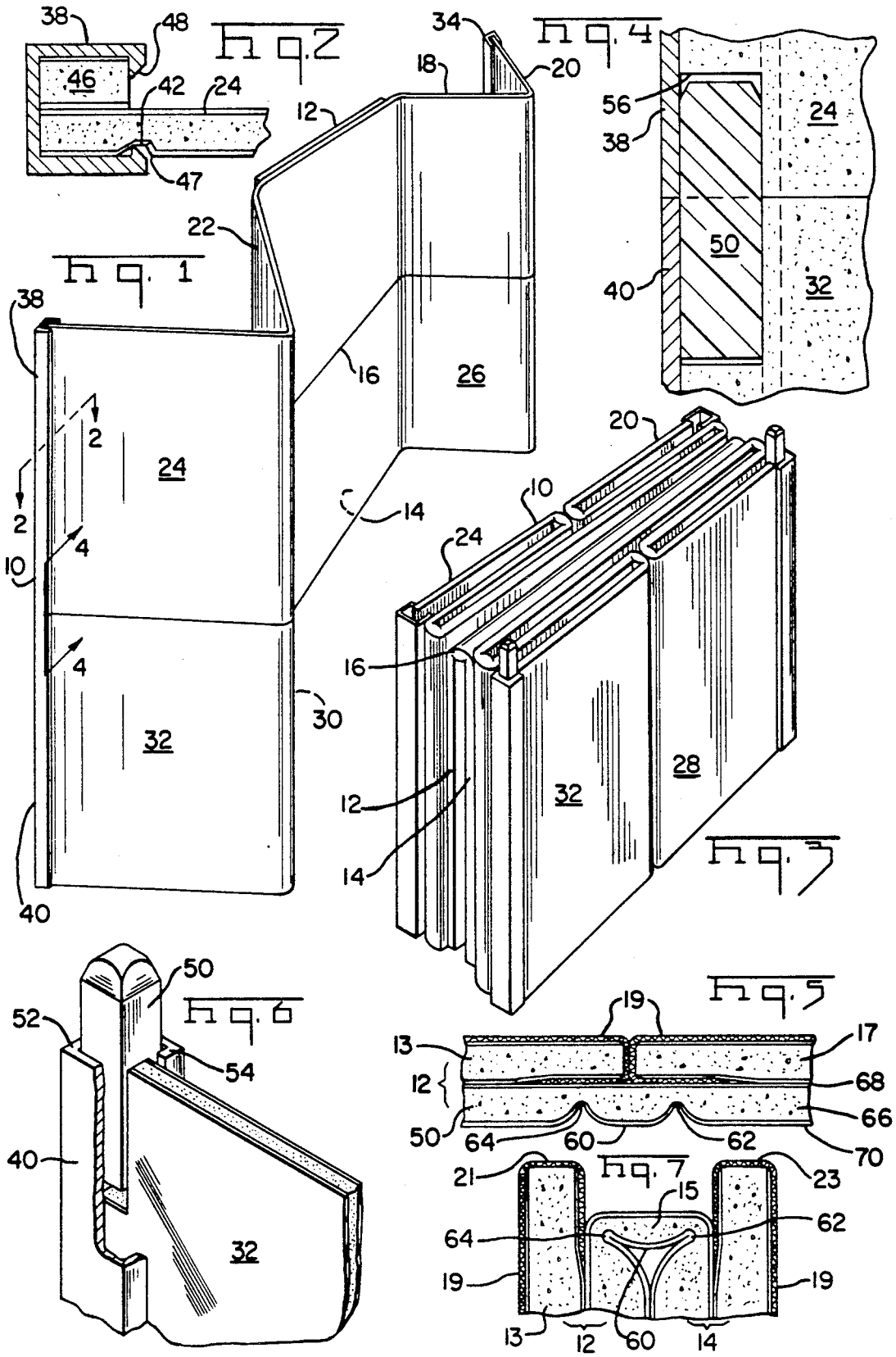
FIG. 1 is a perspective view showing the subject panel device.
FIG. 2 is a section along line 2—2 of FIG. 1 showing the end vertical supports of the panel device.
FIG. 3 is a perspective view showing the panel device in a folded stance.
FIG. 4 is a cross section along line 4—4 of FIG. 1.
FIG. 5 is a cross section view showing the double score hinge element of this invention showing the panel device in an assembled stance.
FIG. 6 is a perspective view showing the means for securing the upper and lower panel sections to each other.
FIG. 7 is a cross section view showing the double score hinge element of the this invention showing the panel device in a folded stance.

Referring to FIG. 1, it can be seen that the panel device of this invention 10 is formed from two panel sections 12 and 14, panel section 12 being the upper panel section and panel section 14 being the lower panel section. Upper panel section 12 is pivotally connected to the lower panel section 14 via a double scored hinged third panel 16, the details of which are shown in FIG. 5, the operation of which is shown in FIG. 7. Upper panel section 12 and lower panel section 14, each flanked on opposite sides by a pair of panel sections. Upper panel section 12 is flanked on the right side by an inner panel section 18 and an outer panel section 20. Upper panel section 12 is flanked on the left side by an inner panel section 22 and an outer panel section 24. Lower panel section 14 is flanked on the right side by an inner panel section 26 and an outer panel section 28 which is not visible in FIG. 1. The left side lower panel section 14 is flanked on the left side by an inner panel 30, not visible in FIG. 1, and an outer panel 31. The outer edges of outer panel sections 20, 24, 28, and 30 are capped with U-shaped channel members. Outer panel section 20 being capped with a U-shaped channel member 34, outer panel section 24 is capped with a U-shaped channel member 38. Outer panel sections 24 and 32 are in turn capped with U-shaped channels 38 and 40. The placement of the outer panel sections 20, 24, 28 and 32 and the respective capping of the U-shaped channels is illustrated in detail in FIG. 2. As can be seen from an examination of FIG. 2, the outer panels incorporate a vertical score 42 which is adapted to engage lip 44 which is integral with U-shaped channel 38. Placed in U-shaped channel 38 is a piece of spacer board 46, spacer 46 is retained in position by lip 48 which is opposite of lip 44.

As can be seen from FIG. 4, panel 32 is notched in such a manner that the upper edge of panel 32 is not engaged with U-shaped channel 40, the notch in panel 32 actively creates a void into which is placed connector plug 50. Connector plug 50 may be secured in U-shaped channel 40 via any convenient means. In the preferred embodiment, the connecting means is a set screw which is screwed through connector 50 to abut against right section 52 U-shaped channel 40. When the set screw is drawn up, connector plug 50 is biased against the lips 52 and 54 of U-shaped channel 40 thereby securing connector plug 50 into U-shaped channel 40.

From FIG. 4, it can be seen that outer panel 24 is notched in such a manner so as to produce a void 56 which is adapted to receive connector plug 50.

FIG. 3 shows the panel device of this invention in a folded up stance. It can be seen all panels of upper panel section 12 and lower panel section 14 fold one upon each other.

Figure 8:
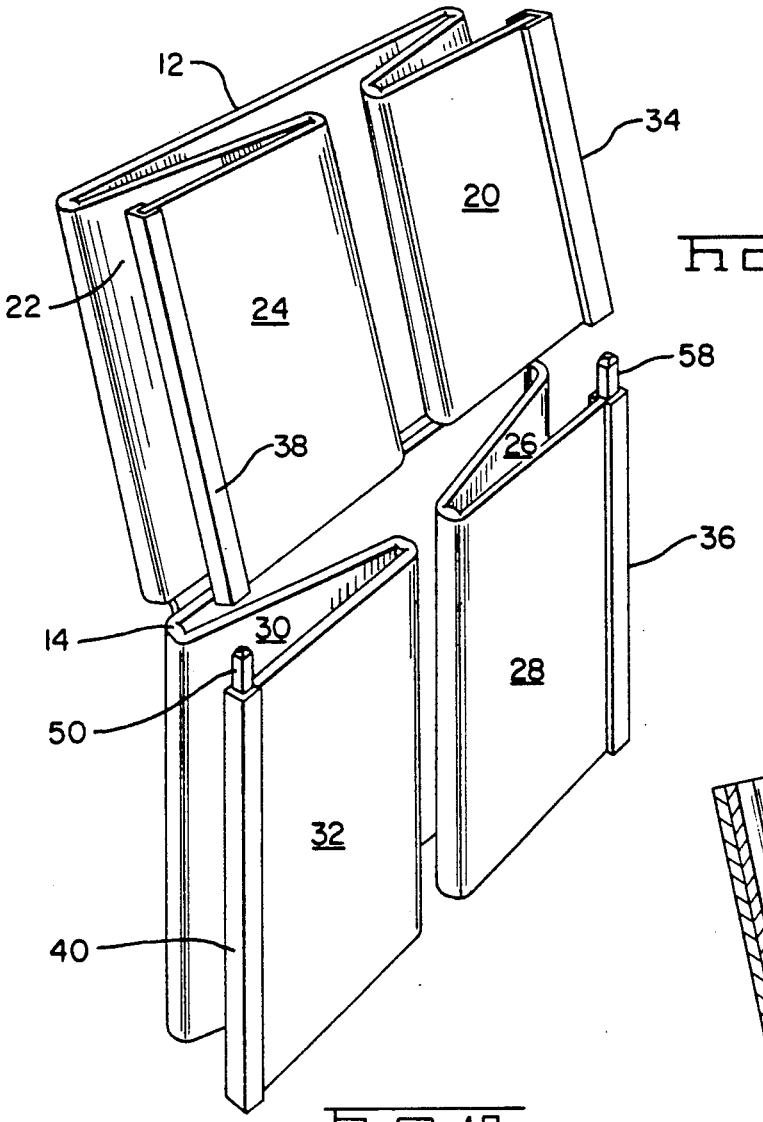
FIG. 8 is a perspective view of the panel device of this invention in a partially assembled stance.
Figure 9:
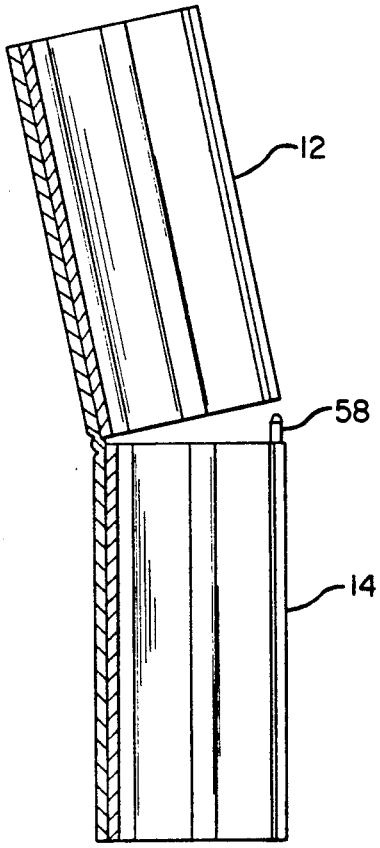
FIG. 9 is an end view showing the panel device of this invention in the partially assembled stance of FIG. 8.
Figure 10:
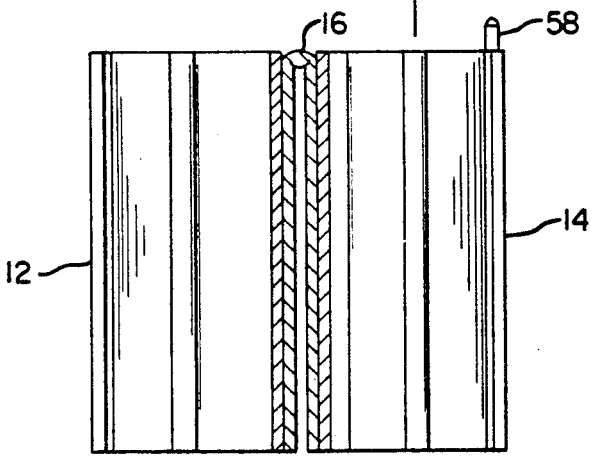
FIG. 10 is an end view showing the panel device of this invention in the partially disassembled state ready for final folding.

In the assembly, as is illustrated in FIG. 8, upper panel section 12 pivots upwardly until lower extremities of U-shaped channels 34 and 38 seat downwardly in such a manner as to engage connector plugs 50 and 58, as is further illustrated in FIG. 9. Once U-shaped channels 34 and 38 are secured in connector plugs 50 and 58, the outer edges which comprise U-shaped channels are drawn out form upper panel 12 and lower panel 14 in order to expand the display. As is illustrated in FIG. 1, inner panels and outer panels may be left angularly disposed to each other in such a manner that the composite display panel device has structural stability which allows it to be free standing.

As can be seen from FIGS. 5 and 7, upper and lower panels 12 and 14 are interconnected via double score panel 15. Double scores 64 and 62 has a central section 60 which acts as a hinge plane, it allows room for upper panel 12 and lower panel 14 to be pivoted in relation to each an in relation to the central panel 60.

As can be seen from the examination of FIGS. 5 and 7, upper panel 12 and lower panel 14, are double plied. Supporting an interconnecting panels 12 and 14 is a backing panel 15. Upper panel 12 further incorporates a display panel 13, in turn lower panel 14 incorporates a display panel 17. FIG. 5 shows the composite lower panel sections in a functional display stance.

In order to present a clean display surface with no hardware showing, it is highly desirable to have the outer display layer 19 as uniform as possible. As can be further seen from FIGS. 5 and 7, display layer 19 is roller around abutting edges 21 and 23 and secured to the back side of display panels 13 and 17 in a manner illustrated in both FIGS. 5 and 7.

The above described arrangement is highly advantageous in that it allows panels 12 and 14 to pivot backwardly on each other for foldup and yet when in a wholly assembled stance, as is illustrated in FIG. 1, a uniform display surface is presented in that there is no hardware shown between the abutting edges of panels 13 and 17.

In the preferred embodiment of this invention, the outer U-shaped channels are of aluminum extrusion, however, polymeric extrusions can likewise be utilized. The preferred embodiment of this invention the panel members are formed from foam board, details of which are evident from FIG. 5. The foam board in question comprises a central core 66 which is a cellular polymeric material which is laminated on opposite sides with noncellular sheets 68 and 70.

In the preferred embodiment, the foldable panel device of this invention is covered with a foam back synthetic fabric, the outer surface of which is capable of functioning as the loop half of a hook and loop fastening system. The material in question is available from a variety of sources. For example, the material may be purchased under the trademark TEMPO LOOP from Gilford Mills.

From the above description, it is evident that the preferred embodiment of this invention comprises a foldable panel device wherein the upper and lower panels are two-ply, as is described above in connection with FIGS. 5 and 7. While the arrangement as is disclosed in FIGS. 5 and 7 produces an excellent portable display, which because of the fact that the display fabric is wrapped around the edges is likewise durable, it is evident to one skilled in the art that the overall structure as it is generally illustrated in FIG. 1, could be formed from a single sheet of material. A single sheet portable display could be used with or without the laminated display surface. For example, if the portable display was formed from a single sheet, it could be used to form a disposable display which could be used once and then discarded.

The preferred cellular sheet material for use in accordance with this invention is sold under the trademark FOAMCORE by Monsanto Chemical Co.

The panel device of this invention has a high strength to weight ratio and an exceptionally high display surface to weight ratio. Further, it can be readily seen from the drawings and from the description above, that the panel device of this invention can be readily assembled and disassembled. Ease of assembly is particularly useful in trade show applications. For the reasons as set forth herein above, the subject invention results in a superior panel device. From the description of FIGS. 1 to 10, it can be seen that the subject invention can be used to produce a wide variety of panel devices. Further, it is understood to one skilled in the art that this invention is not limited to the embodiments as described and illustrated hereinabove.

What is claimed is:

1. A foldable panel device which incorporates a pair of upper and lower panel sections which are horizontally pivotally connected to each other, each of said upper and lower panel sections having at least one lateral panel section depending outwardly therefrom, said lateral panel sections being vertically pivotally connected to said upper and lower panel section and not horizontally pivotally connected to each other.

2. The foldable panel device of claim 1 wherein said lateral panel sections depend outwardly from opposite sides of said upper and lower panel sections.

3. The foldable panel device of claim 1 wherein two lateral panel sections depend outwardly from one vertical side of each of said upper and lower panel sections.

4. The foldable panel device of claim 2 wherein two pivotally connected lateral panel sections depend outwardly from opposite sides of each of said upper and lower panel sections.

5. The foldable panel device of claim 4 wherein each of said lateral panel sections is approximately fifty percent of the width of said upper and lower panel sections.

6. The foldable panel device of claim 2 wherein more than two pivotally connected lateral panel sections depend outwardly from opposite sides of each of said upper and lower panel sections.

7. The foldable panel device of claim 6 wherein each of said lateral panel sections is approximately fifty percent of the width of said upper and lower panel sections.

8. The foldable panel device of claim 1 wherein said upper and lower panel sections are double ply.

9. The foldable panel device of claim 2 wherein said upper and lower panel sections are double ply.

10. The foldable panel device of claim 4 wherein said upper and lower panel sections are double ply.

11. The foldable panel device of claim 1 wherein said upper and lower panel sections are double ply, having an inner play and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

12. The foldable panel device of claim 2 wherein said upper and lower panel sections are double ply, having an inner ply and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

13. The foldable panel device of claim 3 wherein said upper and lower panel sections are double ply, having an inner play and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

14. The foldable panel device of claim 4 wherein said upper and lower panel sections are double ply, having an inner ply and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

15. The foldable panel device of claim 5 wherein said upper and lower panel sections are double ply, having an inner ply and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

16. The foldable panel device of claim 6 wherein said upper and lower panel sections are double ply, having an inner ply and an outer ply, the inner ply being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

17. The foldable panel device of claim 7 wherein said upper and lower panel sections are double ply, having an inner play and an outer play, the inner play being unitary having two main sections which are innerconnected by a hinge panel which is formed by a double score, and wherein the outer ply comprises two separate panels, the horizontal edges of which may abut against each other and which are covered with a display fabric which is wrapped around at least the abutting horizontal edges.

* * * * *